US006109980A

United States Patent [19]

Tsunezawa et al.

[11] Patent Number: 6,109,980

[45] Date of Patent: Aug. 29, 2000

[54] ELECTRIC COMPONENT UNIT WITH LEAD WIRE CONNECTION TERMINAL AND HIGH-VOLTAGE VARIABLE RESISTOR UNIT

[75] Inventors: Ichiro Tsunezawa, Toyama; Kazufumi Daimon, Namerikawa, both of Japan

[73] Assignee: Hokuriku Electric Co., Ltd., Kami-Niikawagun, Japan

[21] Appl. No.: 09/058,340

[22] Filed: Apr. 10, 1998

[30] Foreign Application Priority Data

Apr. 11, 1997 [JP] Japan ..... 9-093765

[51] Int. Cl.[7] ..... H01R 13/40

[52] U.S. Cl. ..... 439/733.1; 361/752

[58] Field of Search ..... 439/733.1, 888, 439/809, 389; 338/118, 128, 219; 310/71; 361/752

[56] References Cited

U.S. PATENT DOCUMENTS

| | | | |
|---|---|---|---|
| 3,327,284 | 6/1967 | Crimmins | 439/389 |
| 4,471,339 | 9/1984 | Fukuda et al. | 338/162 |
| 5,475,358 | 12/1995 | Kotani et al. | 338/70 |
| 5,508,678 | 4/1996 | Tsunezawa et al. | 338/160 |
| 5,517,171 | 5/1996 | Kotani et al. | 338/118 |
| 5,532,669 | 7/1996 | Tsunezawa et al. | 338/184 |
| 5,546,280 | 8/1996 | Hasebe et al. | 361/752 |
| 5,579,213 | 11/1996 | Hasebe et al. | 361/823 |
| 5,877,673 | 3/1999 | Kotani et al. | 338/162 |
| 5,886,616 | 3/1999 | Tsunezawa et al. | 338/160 |

*Primary Examiner*—Paula Bradley
*Assistant Examiner*—Ross Gushi
*Attorney, Agent, or Firm*—Pearne & Gordon LLP

[57] ABSTRACT

A high-voltage variable resistor unit capable of firmly fixing a lead wire connection terminal formed by bending a linear conductor to a terminal fixture of an insulating casing. The terminal fixture is formed with a coupling section receiving recess for receiving a coupling section of the lead wire connection terminal therein in a manner to be in proximity to a terminal holder of a terminal fixing structure including a pair of holding elements. The coupling section of the lead wire connection terminal is pressedly fitted in the coupling section receiving recess and a held section of the terminal is interposedly held between the holding elements of the terminal holder. This effectively prevents rotation of the lead wire connection terminal about the held section, movement of the lead wire connection terminal in a longitudinal direction thereof or removal of the coupling section from the coupling section receiving recess with ease, when external force is applied to the lead wire connection section or held section of the lead wire connection terminal.

5 Claims, 3 Drawing Sheets

ELECTRIC COMPONENT UNIT WITH LEAD WIRE CONNECTION TERMINAL AND HIGH-VOLTAGE VARIABLE RESISTOR UNIT

BACKGROUND OF THE INVENTION

This invention relates to an electric component with a lead wire connection terminal, and more particularly to a high-voltage variable resistor unit.

An electric component unit such as a high-voltage variable resistor unit called a focus pack or the like typically includes a terminal for connection of a lead wire or a lead wire connection terminal which is adapted to connect a lead wire to an end of an insulating casing of the unit by soldering. The connection is conventionally carried out in such a manner that the lead wire connection terminal is interposedly held at a part thereof in at least one terminal holder which is provided on a terminal fixture arranged on an edge of the insulating casing and includes a pair of holding elements. However, holding of the lead wire connection terminal in the terminal holder while interposing it between the holding elements has a disadvantage that application of excessive or improper force to the lead wire connection terminal causes raising of the lead wire connection terminal, leading to a failure in centering or accurate positioning of the lead wire connection terminal. Also, holding of the lead wire connection terminal in the terminal holder has another disadvantage of causing rotation or pivotal movement of the lead wire connection terminal, when the lead wire connection terminal is made by bending a rod-like or linear conductor of a circular shape in cross section. In order to eliminate raising of the lead wire connection terminal and rotation thereof, techniques of breaking the terminal holder by welding or those of mounting, on the terminal fixture of the insulating casing, a combined component which is engaged with a part of the lead wire connection terminal to prevent rotation of the terminal are proposed as disclosed in Japanese Utility Model Application No. 57435/1989 and Japanese Patent Applications Nos. 204900/1992 and 78876/1994, respectively.

However, the lead wire connection terminal fixing structure proposed requires welding or the combined component for mounting the terminal. Also, holding of the lead wire connection terminal in the terminal holder while interposing it between the holding elements causes rotation of the lead wire connection terminal, leading to a failure in soldering. This, when the electric component unit such as the high-voltage variable resistor unit or the like is to be incorporated in an electric appliance, causes displacement or deviation of the lead wire connection terminal, resulting in the incorporation being failed or the electric appliance being defective.

SUMMARY OF THE INVENTION

The present invention has been made in view of the foregoing disadvantages of the prior art.

Accordingly, it is an object of the present invention to provide an electric component unit which is capable of permitting a lead wire connection terminal formed by bending a linear conductor to be firmly mounted on an insulating casing through only a fit structure.

It is another object of the present invention to provide an electric component unit which is capable of restraining deformation of a lead wire connection section of a lead wire connection terminal to which a lead wire is connected by soldering.

It is a further object of the present invention to provide an electric component unit which is capable of substantially preventing a lead wire wound on a lead wire connection section of a lead wire connection terminal from being detached or removed from the lead wire connection section.

It is still another object of the present invention to provide a high-voltage variable resistor unit which is capable of permitting a lead wire connection terminal formed by bending a linear conductor to be firmly mounted on an insulating casing through only a fit structure.

In accordance with the present invention, an electric component unit is provided, which generally includes an insulating casing constructed so as to receive an electric component therein and integrally provided with a terminal fixture, at least one terminal holder arranged at the terminal fixture and including at least a pair of holding elements, and at least one lead wire connection terminal including a held section interposedly held between the holding elements and a lead wire connection section to which a lead wire for connection extending from the electric component is connected by soldering. In the electric component unit, the lead wire connection terminal is formed by bending a linear conductor and includes a coupling section arranged between the held section and the lead wire connection section to couple the held section and lead wire connection section to each other therethrough. The terminal fixture of the insulating casing is formed with at least one coupling section receiving recess for receiving the coupling section therein in a manner to be in proximity to the terminal holder. The coupling section of the lead wire connection terminal and the coupling section receiving recess of the terminal fixture are constructed so as to receive the coupling section in the coupling section receiving recess while pressedly fitting it therein and prevent rotation of the lead wire connection terminal about the held section, movement of the lead wire connection terminal in a longitudinal direction thereof or removal of the coupling section from the coupling section receiving recess with ease, when external force is applied to the lead wire connection section or held section of the lead wire connection terminal while keeping the held section interposedly held in the terminal holder of the terminal fixing structure.

The above-described construction of the present invention facilitates firm fixing of the lead wire connection terminal to the terminal fixture of the insulating casing. Thus, the present invention eliminates welding and any additional parts for fixing of the terminal.

In a preferred embodiment of the present invention, the coupling section of the lead wire connection terminal includes a first linear coupling portion having one end connected to the held section, a second linear coupling portion juxtaposed to the first linear coupling portion and having one end connected to the lead wire connection section, and a mutual coupling portion connected to the other end of each of the first and second linear coupling portions to couple the first and second linear coupling portions to each other. The coupling section of the lead wire connection terminal is constructed so that the first and second linear coupling portions are contacted with each other in a longitudinal direction thereof while being pressedly fitted in the coupling section receiving recess. The first and second linear coupling portions of the coupling section may be kept contacted with each other before the coupling section is received in the coupling section receiving recess. Alternatively, the first and second linear coupling portions of the coupling section may be rendered contacted with each other after the coupling section is received in the coupling section receiving recess. Such mutual contacting between the first linear coupling portion and the second linear coupling portion in the longitudinal direction substantially prevents deformation of the first and second linear coupling portions and removal of the coupling section from the coupling section receiving recess with ease, even when any external force is applied to the lead wire connection terminal while the coupling section is kept received in the coupling section receiving recess.

In order to prevent easy removal of the coupling section form the coupling section receiving recess, it is required to increase a length of the coupling section to a degree. Further, when the lead wire connection terminal is formed by bending a linear conductor, it is desirable to simplify a structure of the terminal and facilitate use thereof. For this purpose, the held section, lead wire connection section and coupling section of the lead wire connection terminal have longitudinal axes defined in a substantially common plane, respectively. Also, the second linear coupling portion is formed into a length larger than that of the first linear coupling portion and the held section and lead wire connection section of the lead wire connection terminal are arranged so as to extend in directions across directions in which the first and second linear coupling portions, respectively.

When the lead wire is wound on the lead wire connection section of the lead wire connection terminal, followed by welding, it is preferable to facilitate winding of the lead wire on the lead wire connection section and prevent easy removal of the wound lead wire from the lead wire connection section. For this purpose, the coupling section receiving recess may be constructed so as to include a first portion positioned on a side opposite to a side of the lead wire connection section based on or about the longitudinal axis of the held section of the lead wire connection terminal and a second portion positioned on the side of the lead wire connection section. The first portion of the coupling section receiving recess is defined by a bottom-closed cylindrical first wall surface and the second portion thereof is defined by a second wall surface of a U-shape in cross section which is open toward the terminal holder and in a direction way from the bottom of the first wall. The holding elements cooperate with a wall section having the second wall surface to define a gap therebetween. The lead wire connection terminal is so constructed that the longitudinal axes of the lead wire connection section and held section of the lead wire connection terminal are rendered substantially parallel to each other. Such construction permits the lead wire to be wound on the lead wire connection section through the gap defined between the wall portion including the second wall surface and the holding elements in a pair. This facilitates winding of the lead wire on the lead wire connection section, even when the lead wire connection section is positioned in proximity to a distal end of the holding elements in a pair, to thereby permit the holding elements to function as a stopper for preventing the lead wire wound on the lead wire connection section from being removed therefrom. When the holding elements are thus used as the stopper, the lead wire connection section and held section of the lead wire connection terminal may be arranged in such a manner that a distance between the longitudinal axes thereof is defined so as to permit the holding elements to prevent an end of the lead wire from being removed from the lead wire connection section.

The present invention may be applied to a variety of electric component units. In particular, the present invention exhibits significant advantages when it is applied to a high-voltage variable resistor unit. When the present invention is applied to a high-voltage variable resistor unit, the lead wire connected to the lead wire connection section of the lead wire connection terminal may be a lead wire extending from an electric component such as a lead terminal of a capacitor connected to an electrode incorporated in a variable resistor pattern. Instead, it may be a lead wire extending from another electronic component received in the insulating casing.

Further, the present invention may be likewise applied to a high-voltage variable resistor unit which is in the form of a fly-back transformer attached to a casing therefor. The fly-back transformer is so constructed that a large part of lead wire connection terminals are embedded in insulating resin of which the transformer is formed by molding. Thus, when the insulating resin for molding is charged in a die while leaving the lead wire connection terminals unstable or movable, it is substantially impossible to positionally correct the lead wire connection terminals incorrectly positioned, resulting in the fly-back transformer being defective. The present invention effectively eliminates such a disadvantage, to thereby substantially increase yields thereof.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate like or corresponding parts throughout; wherein.

DETAILED DESCRIPTION OF THE PREFERRED EMBODIMENT

Now, an electric component unit according to the present invention will be described hereinafter with reference to the accompanying drawings.

Figure 1:
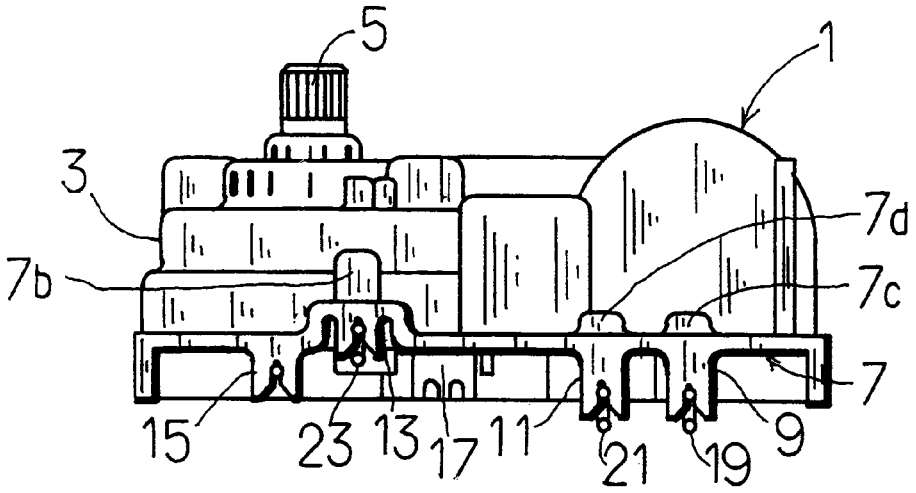
FIG. 1 is a front elevation view showing an embodiment of an electric component unit according to the present invention, which is in the form of a high-voltage variable resistor unit.
Figure 2A:
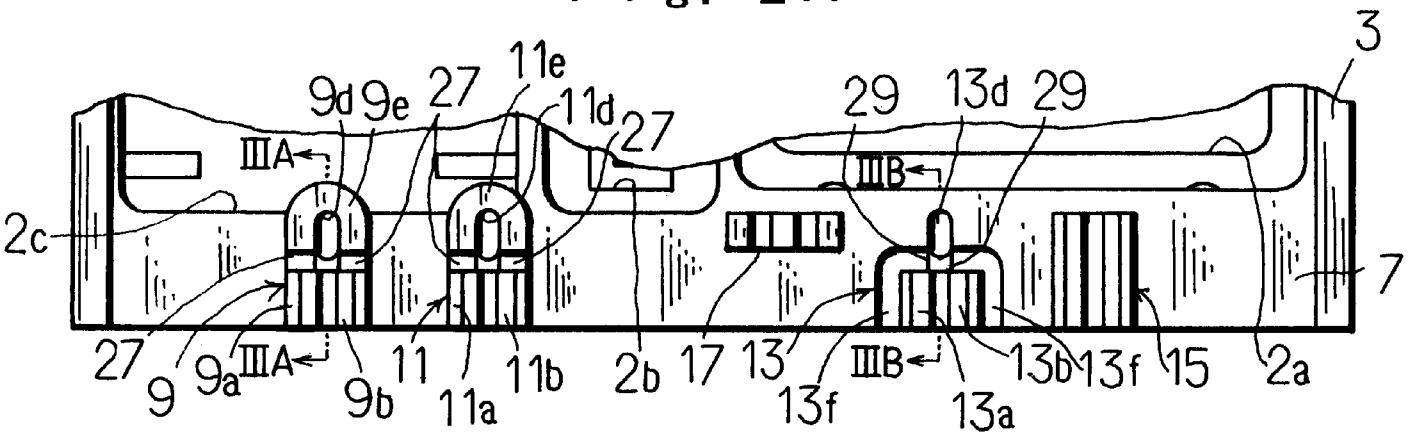
FIG. 2A is an enlarged bottom view showing a terminal fixture integrally arranged on an insulating casing of the high-voltage variable resistor unit of FIG. 1.
Figure 2B:
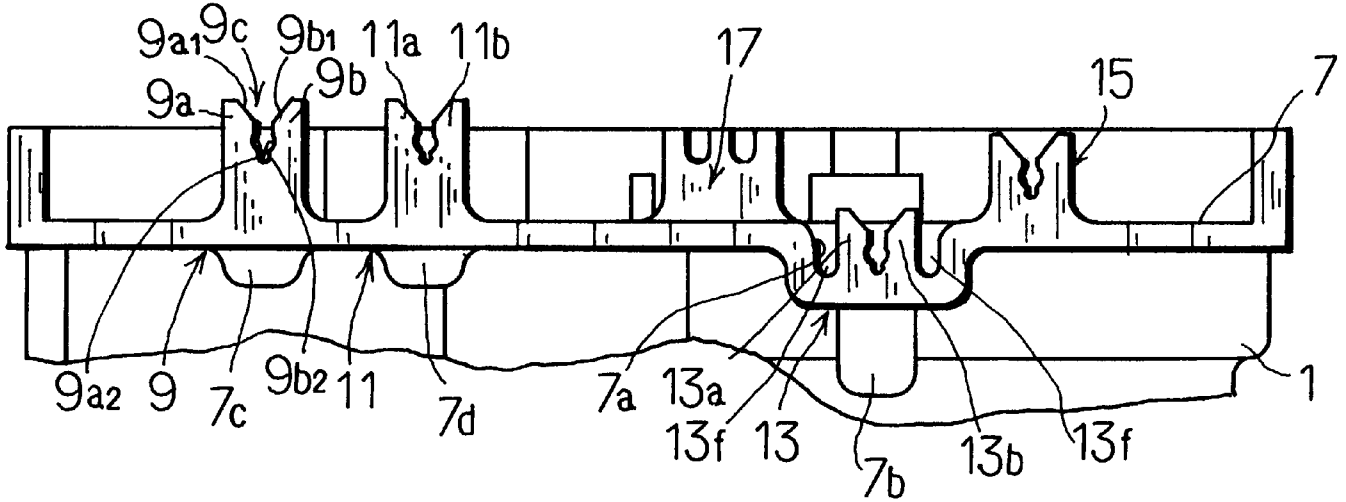
FIG. 2B is an enlarged front elevation view of the terminal fixture shown in FIG. 2A.

Referring first to FIGS. 1 to 2B, an embodiment of an electric component unit according to the present invention is illustrated, which is embodied in the form of a high-voltage variable resistor unit by way of example. A high-voltage variable resistor unit of the illustrated embodiment which is generally designated by reference numeral 1 is constructed into a so-called double-focus type structure for outputting two focus voltages and a screen voltage. The high-voltage variable resistor unit 1 includes an insulating casing 3 integrally formed of an insulating resin material so as to having an opening on a bottom side thereof or a lower side thereof in FIG. 1. The insulating casing 3, as shown in FIG. 2A, is formed therein with a variable resistance circuit board receiving chamber 2*a,* a fixed resistance circuit board receiving chamber 2*b* and a capacitor receiving chamber 2*c*. The variable resistance circuit board receiving chamber 2*a* is adapted to receive a variable resistance circuit board (not shown) therein. The variable resistance circuit board includes an insulating substrate and a variable resistor circuit pattern including three variable resistance elements and arranged on a front surface of the insulating substrate. The fixed resistance circuit board receiving chamber 2*b* is adapted to receive therein a fixed resistance circuit board (not shown) which includes an insulating substrate and a breeder resistance element formed on the insulating substrate. The capacitor receiving chamber 2*c* is adapted to receive therein a capacitor (not shown) connected between an input terminal (not shown) and a ground resistance (not shown). The high-voltage variable resistor unit 1 also includes three operation shafts 5 arranged in a manner to be spaced from each other at intervals and so as to upwardly project from an upper wall of the insulating casing 3. Between the variable resistance circuit board (not shown) and the upper wall of the insulating casing 3 are arranged three slide operation members (not shown) each of which includes each of the operation shafts 5 and has a slide (not shown) mounted thereon. The slide is arranged so as to slide on the variable resistance corresponding thereto.

The insulating casing 3 is provided on the above-described bottom side thereof with a terminal fixture 7 in a manner to be integral therewith. The terminal fixture 7 is formed into a plate-like shape and arranged so as to extend in a longitudinal direction of the opening of the insulating casing from one of laterally extending sides of the opening. The terminal fixture 7 is integrally formed on a rear surface thereof with first to third terminal fixing structures 9, 11 and 13 for respectively fixing lead wire connection terminals 19, 21 and 23 as described hereinafter, a fourth terminal fixing structure 15 and a lead wire holder 17 for holding a lead wire. The fourth terminal fixing structure 15 has one end connected to a ground electrode of the above-described variable resistance circuit pattern formed on a front surface of the variable resistance circuit board (not shown) and the other end on which the above-described ground terminal extending from a rear surface of the variable resistance circuit board toward the terminal fixture 7 is fixed.

The first and second terminal fixing structures 9 and 11 are constructed into the same configuration and have the lead wire connection terminals 19 and 21 fixed thereon, respectively, to which lead wires of the capacitor received in the capacitor receiving chamber 2*c* are connected. The lead wire connection terminals 19 and 21 are selectively used depending on a structure of a fly-back transformer with which the electric component unit of the illustrated embodiment is combined. Thus, actually any one of the lead wire connection terminals 19 and 21 is used. The third terminal fixing structure 13 has the lead wire connection terminal 23 fixed thereon, to which a lead wire of the capacitor arranged between one of focus voltage output electrodes and the ground is connected. The lead wire holder 17 has a lead wire held thereon, which is connected to the lead wire connection terminal 23 held thereon.

Figure 3A:
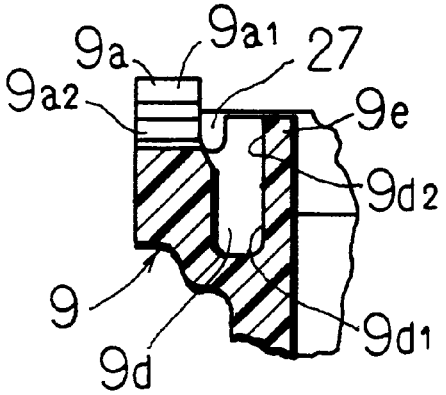
FIG. 3A is a sectional view taken along line IIIA—IIIA of FIG. 2A.
Figure 4:
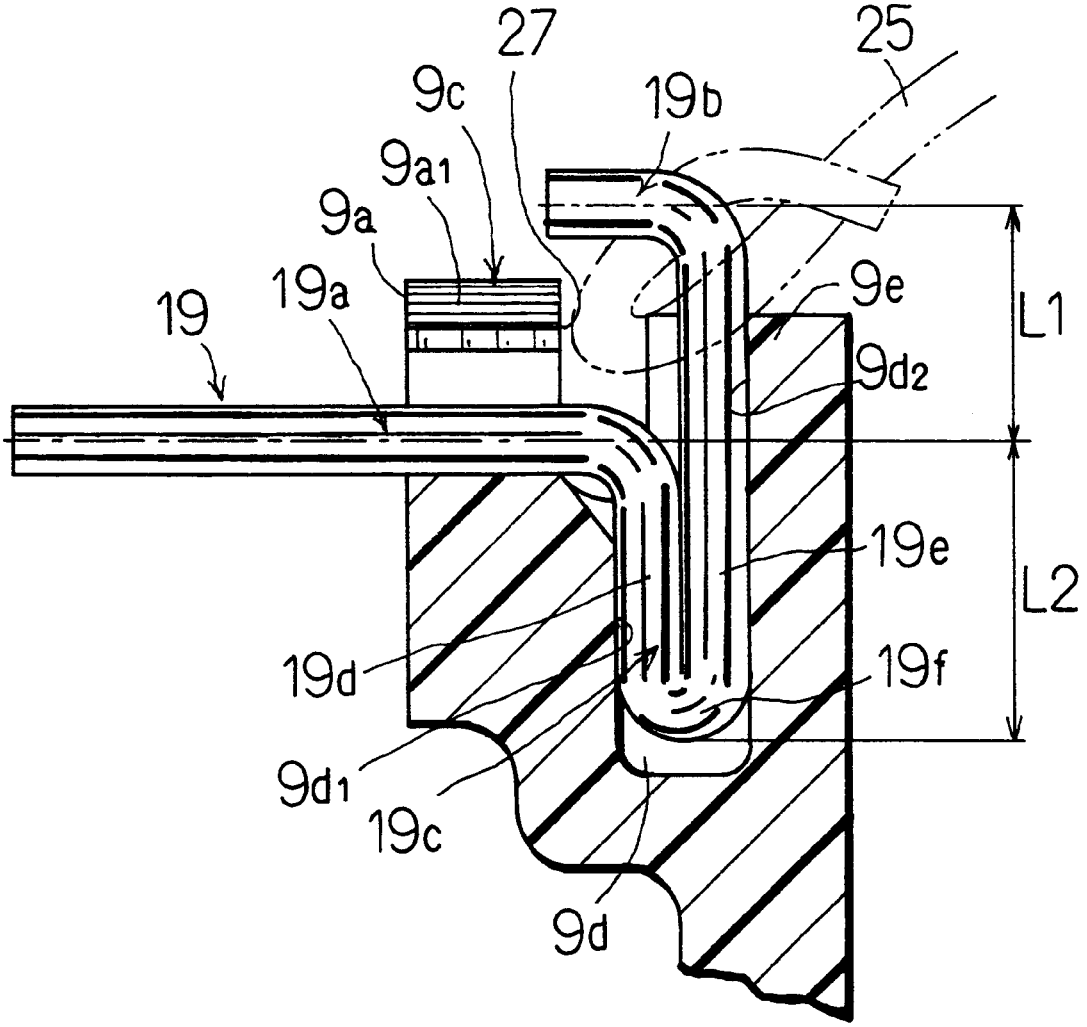
FIG. 4 is a sectional view showing a terminal fixture having a lead wire connection terminal fixed therein.

The first terminal fixing structure 9 may be constructed in such a manner as shown in FIG. 3A and the lead wire connection terminal 19 may be fixed on the terminal fixing structure 9 as shown in FIG. 4. The first and second terminal fixing structures 9 and 11 have the same structure and the lead wire connection terminals 19, 21 and 23 are constructed into the same structure. Thus, the following description will be made on only the first terminal fixing structure 9 and lead wire connection terminal 19 by way of example.

The lead wire connection terminal 19 is made by bending a linear conductor which has rigidity to a degree and is bendable. The linear conductor has a substantially circular shape in cross section. A piano wire may be used for this purpose. The lead wire connection terminal 19, as shown in FIG. 4, includes a held section 19*a* interposedly held between a pair of holding elements 9*a* and 9*b* (FIGS. 2A and 2B) described hereinafter, a lead wire connection section 19*b* to which a lead wire for connection extending from the capacitor (electric component) is connected by welding, and a coupling section 19*c* arranged between the held section 19*a* and the lead wire connection section 19*b* to couple both to each other therethrough. The coupling section 19*c* includes a first linear coupling portion 19*d* having one end connected to the held section 19*a,* a second linear coupling portion 19*e* juxtaposed to the first linear coupling portion 19*d* and having one end connected to the lead wire connection section 19*b*, and a mutual coupling portion 19*f* connected to the other end of each of the first and second linear coupling portions 19*d* and 19*e* to couple the first and second linear coupling portions 19*d* and 19*e* to each other therethrough. The lead wire connection terminal 19 is so arranged that longitudinal axes of the held section 19*a,* lead wire connection section 19*b* and coupling section 19*c* (first and second linear coupling portions 19*d* and 19*e*) are defined or positioned substantially in a common plane. The second linear coupling portion 19*e* is formed into a length larger than that of the first linear coupling portion 19*d*. The lead wire connection section 19*b* is arranged in a manner to be substantially perpendicular to the second linear coupling portion 19*e* and substantially parallel to the held section 19*a*. More specifically, the held section 19*a* and lead wire connection section 19*b* of the lead wire connection terminal 19 are arranged so as to extend in a direction across a direction in which the first and second linear coupling portions 19*d* and 19*e* extend. Further, the lead wire connection terminal 19 is formed in such a manner that a distance L1 between the longitudinal axis of the held section 19*a* and that of the lead wire connection section 19*b* is smaller than a distance L2 between the axis of the held section 19*a* and a distal end of the coupling section 19*c* or an end of the mutual coupling portion 19*f*. Such an increase in distance L2 as compared with the distance L1 ensures secure fixing of the lead wire connection terminal 19 in the terminal fixing structure 9.

The terminal fixing structure 9, as shown in FIGS. 2A and 2B, includes a terminal holder 9*c* including a pair of holding elements 9*a* and 9*b* provided on the terminal fixture 7 and a coupling section receiving recess 9*d* arranged adjacently to or in proximity to the terminal holder 9*c* so as to receive the coupling section 19*c* of the lead wire connection terminal 19 therein. The holding elements 9*a* and 9*b* in a pair include inclined surfaces 9*a*1 and 9*b*1 each inclined so as to form a receiving opening and curved portions 9*a*2 and 9*b*2 each contacted with an outer peripheral surface of the held section 19*a* of the lead wire connection terminal 19, respectively. The coupling section receiving recess 9*d* includes a first portion 9*d*1 positioned on a side opposite to a side of the lead wire connection section 19*b* based on or about the longitudinal axis of the held section 19*a* of the lead wire connection terminal 19 and a second portion 9*d*2 positioned on the side of the lead wire connection section 19*b*. The first portion 9*d*1 is defined by a first wall surface of a bottom-closed cylindrical shape and the second portion 9*d*2 is defined by a second wall surface of a U-shape in cross section which is open in both a direction toward the terminal holder and a direction way from the above-described bottom or both a left-hand direction and an upper direction in FIG. 4. Between a wall section 9*e* having the second wall surface and the holding elements 9*a* and 9*b* in a pair is defined a gap which permits a lead wire 25 securely wound on the lead wire connection section 19*b* by soldering to pass therethrough. Such construction permits the lead wire 25 to be wound on the lead wire connection section 19*b* through the gap 27. Thus, winding of the lead wire 25 on the lead wire connection section 19*b* may be smoothly carried out, even when the lead wire connection section 19*b* is positioned in proximity to a distal end of the holding elements 9*a* and 9*b* so that the holding elements 9*a* and 9*b* may function as a stopper for preventing detaching or removal of the wound lead wire 25 from the lead wire connection section 19*b*. The distance L1, as shown in FIG. 4, is set so as to ensure that the holding elements 9*a* and 9*b* act as a stopper for preventing an end of the lead wire 25 wound on the lead wire connection section 19*b* from being removed from the lead wire connection section 19*b*.

The coupling section 19*c* of the lead wire connection terminal 19 and the coupling section receiving recess 9*d* of the terminal fixing structure 9 are constructed so as to ensure that the coupling section 19*c* is received in the coupling section receiving recess 9*d* while being pressedly fitted therein or keeping the first and second linear coupling portions 19*d* and 19*e* of the coupling section 19*c* tightly contacted with the wall surface of the recess 9*d* and more specifically the wall surface of the first portion 9*d*1. Also, the coupling section 19*c* of the lead wire connection terminal 19 and the coupling section receiving recess 9*d* of the terminal fixing structure 9 are constructed so as to prevent rotation or pivotal movement of the lead wire connection terminal 19 about the held section 19*a* thereof, movement of the lead wire connection terminal 19 in the longitudinal direction thereof or removal of the coupling section 19*c* from the coupling section receiving recess 9*d* with ease, when any external force is applied to the lead wire connection section 19*b* or held section 19*a* of the lead wire connection terminal 19 while keeping the held section 19*a* interposedly held in the terminal holder 9*c* of the terminal fixing structure 9. More specifically, the coupling section 19*c* of the lead wire connection terminal 19 is constructed so that the first linear coupling portion 19*d* and second linear coupling portion 19*e* of the terminal 19 are contacted with each other while keeping the coupling section 19*c* pressedly fitted in the coupling section receiving recess 9*d*. The first and second linear coupling portions 19*d* and 19*e* may be kept contacted with each other prior to fitting thereof in the coupling section receiving recess 9*d*. Alternatively, the first and second linear coupling portions 19*d* and 19*e* may be rendered contacted with each other after the fitting in the coupling section receiving recess 9*d*.

Figure 3B:
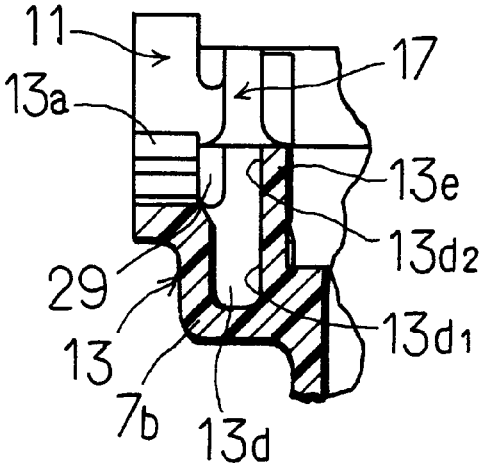
FIG. 3B is a sectional view taken along line IIIB—IIIB of FIG. 2A.

The third terminal fixing structure 13 will be described hereinafter with reference to FIGS. 2A, 2B and 3B as well as FIG. 1. The third terminal fixing structure 13 is arranged at the terminal fixture 7 so as to be positioned below the first and second terminal fixing structures 9 and 11 in FIG. 2B. In other words, the third terminal fixing structure is arranged in proximity to the front surface of the insulating casing 3 or the operation shafts 5 as compared with the first and second terminal fixing structures 9 and 11 as shown in FIG. 1. For this purpose, the terminal fixture is formed with a recess or step 7*a*. The step 7*a* is integrally provided with a pair of holding elements 13*a* and 13*b*, to thereby provide a terminal holder. This results in a groove 13*f* of a substantially U-shape being formed around the holding elements 13*a* and 13*b* as shown in FIGS. 2A and 2B. Arrangement of the U-shaped groove 13*f* permits the holding elements 13*a* and 13*b* to be displaced in a direction of a width thereof. Also, the terminal fixture 7 is integrally formed with an expansion 7*b* which acts to define a coupling section receiving recess 13*d*. The expansion 7*b* is formed into a size larger than expansions 7*c* and 7*d* for the first and second terminal fixing structure 9 and 11. The coupling section receiving recess 13*d*, as shown in FIG. 3B, is likewise constituted by a first portion 13*d*1 and a second portion 13*d*2. Between a wall section 13*e* and the holding elements 13*a* and 13*b* in a pair is defined a gap 29 which permits a lead wire securely wound on a lead wire connection section by soldering to pass therethrough.

Although the above description has been made on the high-voltage variable resistor unit, the present invention may be effectively applied to a fly-back transformer including the high-voltage variable resistor unit described above. Also, the present invention may be likewise applied to any other electric component units including a lead wire connection terminal.

As can be seen from the foregoing, the electric component unit of the present invention is so constructed that the coupling section of the lead wire connection terminal is pressedly fitted in the coupling section receiving recess and rotation or movement of the lead wire connection terminal is prevented. Such construction permits the lead wire connection terminal to be firmly fixed in the terminal fixture of the insulating casing merely by interposedly holding the held section of the lead wire connection terminal in the terminal holder and receiving the coupling section of the lead terminal connection terminal in the coupling section receiving recess of the terminal fixing structure while eliminating a necessity of welding and any additional parts for fixing of the terminal.

While a preferred embodiment of the invention has been described with a certain degree of particularity with reference to the drawings, obvious modifications and variations are possible in light of the above teachings. It is therefore. to be understood that within the scope of the appended claims, the invention may be practiced otherwise than as specifically described.

What is claimed is:

1. An electric component unit comprising:

an insulating casing constructed so as to receive an electric component therein and integrally provided with a terminal fixture;

at least one terminal holder arranged at said terminal fixture and including at least a pair of holding elements; and at least one lead wire connection terminal including a held section and a lead wire connection section, said held section being interposedly held between said holding elements, said lead wire connection section being connected to a lead wire extending from said electric component by soldering;

said lead wire connection terminal being formed by bending a linear conductor and including a coupling section arranged between said held section and said lead wire connection section, said coupling section serving to couple said held section and said lead wire connection section to each other;

said coupling section of said lead wire connection terminal including a first linear coupling portion having one end connected to said held section, a second linear coupling portion juxtaposed to said first linear coupling portion and having one end connected to said lead wire connection section, and a mutual coupling portion connected to the other end of each of said first and second linear coupling portions to couple said first and second linear coupling portions to each other;

said terminal fixture of said insulating casing being formed with at least one coupling section receiving recess for pressedly fitting said coupling section therein in a manner to be in proximity to said terminal holder;

said coupling section of said lead wire connection terminal being constructed so that said first and second linear coupling portions are contacted with each other in a longitudinal direction thereof while being pressedly fitted in said coupling section receiving recess;

wherein longitudinal axes of said held section, said lead wire connection section, and said coupling section of said lead wire connection terminal are in a substantially common plane.

2. An electric component unit as defined in claim 1, wherein said coupling section receiving recess includes a first portion positioned on a side opposite to a side of said lead wire connection section about the longitudinal axis of said held section of said lead wire connection terminal and a second portion positioned on the side of said lead wire connection section;

said first portion of said coupling section receiving recess being defined by a closed-bottom cylindrical first wall surface and said second portion of said coupling section being defined by a second wall surface, said second wall surface being U-shaped in cross section and open toward said terminal holder and in a direction way from said bottom of said first wall;

said holding elements cooperate with a wall section, which includes said second wall surface, to define a gap therebetween; and said lead wire connection terminal is so constructed that the longitudinal axes of said lead wire connection section and held section of said lead wire connection terminal are rendered substantially parallel to each other.

3. An electric component unit as defined in claim 1, wherein said second linear coupling portion has a length which is larger than a length of said first linear coupling portion; and said held section and lead wire connection section of said lead wire connection terminal extend in directions transverse to directions in which said first and second linear coupling portions extend.

4. An electric component unit as defined in claim 3, wherein said lead wire connection section and held section of said lead wire connection terminal are arranged such that a distance between the longitudinal axes thereof permits said holding elements to prevent an end of said lead wire, which is wound on the lead wire connection section, from being removed from said lead wire connection section before being soldering thereto.

5. A high-voltage variable resistor unit comprising:

an insulating substrate provided on a front surface thereof with a variable resistance pattern;

an insulating casing having a substrate receiving chamber defined therein for receiving said insulating substrate therein;

at least one slide arranged between said front surface of said insulating substrate and a wall of said insulating casing so as to slide on said variable resistance pattern;

at least one slide operating member including an operation shaft arranged so as to rotatably extend through said wall of said insulating casing and mounted thereon with said slide;

a terminal fixture integrally provided on said insulating casing;

at least one terminal holder including a pair of holding elements integrally arranged on a rear surface side of said terminal fixture; and at least one lead wire connection terminal including a held section and a lead wire connection section, said held section being interposedly held between said holding elements, said lead wire connection section being connected to a lead wire by soldering;

said lead wire connection terminal being formed by bending a linear conductor and including a coupling section arranged between said held section and said lead wire connection section, said coupling section serving to couple said held section and said lead wire connection section to each other;

said coupling section of said lead wire connection terminal including a first linear coupling portion having one end connected to said held section, a second linear coupling portion juxtaposed to said first linear coupling portion and having one end connected to said lead wire connection section, and a mutual coupling portion connected to the other end of each of said first and second linear coupling portions to couple said first and second linear coupling portions to each other;

said terminal fixture of said insulating casing being formed with at least one coupling section receiving recess for receiving said coupling section therein so as to be in proximity to said terminal holder;

said coupling section of said lead wire connection terminal and said coupling section receiving recess of said terminal fixture being constructed so as to receive said coupling section in said coupling section receiving recess while pressedly fitting it therein and prevent rotation of said lead wire connection terminal about said held section and movement of said lead wire connection terminal in a longitudinal direction thereof while keeping said held section of said lead wire connection terminal interposedly held in said terminal holder of said terminal fixing structure;

said coupling section of said lead wire connection terminal and said coupling section receiving recess of said terminal fixture being constructed so that said first and second linear connection portions engage each other in a longitudinal direction of said coupling section receiving recess;

wherein longitudinal axes of said held section, said lead wire connection section, and said coupling section of said lead wire connection terminal are in a substantially common plane.

* * * * *